US005659343A

United States Patent [19]

Koizumi et al.

[11] Patent Number: 5,659,343

[45] Date of Patent: Aug. 19, 1997

[54] METHOD OF FORMING AN INK JET RECORDING HEAD HAVING AN ORIFICE PLATE WITH POSITIONING OPENINGS FOR PRECISELY LOCATING DISCHARGE PORTS IN A RECORDING APPARATUS

[75] Inventors: Yutaka Koizumi, Tokyo; Minoru Nozawa; Toshihiro Mori, both of Hiratsuka; Atsushi Saito, Yokohama, all of Japan

[73] Assignee: Canon Kabushiki Kaisha, Tokyo, Japan

[21] Appl. No.: 376,374

[22] Filed: Jan. 23, 1995

Related U.S. Application Data

[63] Continuation of Ser. No. 982,057, Nov. 25, 1992, abandoned, which is a continuation of Ser. No. 781,676, Oct. 24, 1991, abandoned, which is a continuation of Ser. No. 662,501, Feb. 28, 1991, abandoned, which is a continuation of Ser. No. 368,588, Jun. 20, 1989, abandoned.

[30] Foreign Application Priority Data

Jun. 21, 1988 [JP] Japan ..... 63-151083
Jun. 20, 1989 [JP] Japan ..... 1-155581

[51] Int. Cl.[6] ..... B41J 2/16

[52] U.S. Cl. ..... 347/47; 347/42; 29/890.1

[58] Field of Search ..... 347/47, 44, 42, 347/20, 49, 65, 63; 29/890.1

[56] References Cited

U.S. PATENT DOCUMENTS

| | | | |
|---|---|---|---|
| 4,047,186 | 9/1977 | Kendall et al. | 347/47 |
| 4,364,059 | 12/1982 | Nagayama | 347/89 |
| 4,434,430 | 2/1984 | Koto | 347/20 X |
| 4,450,455 | 5/1984 | Sugitani | 347/45 |
| 4,477,823 | 10/1984 | Matsufujii | 347/42 |
| 4,499,478 | 2/1985 | Matsufujii | 347/42 |
| 4,499,480 | 2/1985 | Takatori | 347/42 |
| 4,528,575 | 7/1985 | Matsuda | 347/71 |
| 4,580,148 | 4/1986 | Domoto | 347/42 X |
| 4,605,939 | 8/1986 | Hubbard | 347/40 X |
| 4,623,904 | 11/1986 | Conta | 347/68 |
| 4,703,333 | 10/1987 | Hubbard | 347/40 |
| 4,709,246 | 11/1987 | Piatt | 347/40 |
| 4,914,562 | 4/1990 | Abe | 347/63 |
| 4,980,703 | 12/1990 | Sakurai | 347/44 X |

*Primary Examiner*—Joseph W. Hartary
*Attorney, Agent, or Firm*—Fitzpatrick, Cella, Harper & Scinto

[57] ABSTRACT

An ink jet recording apparatus comprises a recording head for recording on a recording medium, which recording head includes a head body member having a plurality of thermal energy generating elements to discharge liquid for recording and an orifice plate having a plurality of discharge ports for discharging liquid therethrough in response to the thermal energy generated by the generating elements. The orifice plate includes a junction portion attached to the head body member, extension portions protruding from two ends of the junction portion and positioning openings in the extension portions, which positioning openings are precisely located relative to the discharge ports. The apparatus includes positioning pins flanking a head-mounting opening in the apparatus that accepts the head body member, and the positioning pins cooperate with the positioning openings to accurately position the discharge ports in the apparatus when the head body member is inserted in the head-mounting opening.

6 Claims, 7 Drawing Sheets

METHOD OF FORMING AN INK JET RECORDING HEAD HAVING AN ORIFICE PLATE WITH POSITIONING OPENINGS FOR PRECISELY LOCATING DISCHARGE PORTS IN A RECORDING APPARATUS

This application is a continuation-in-part continuation, of application Ser. No. 07/982,057 filed Nov. 25, 1992, now abandoned, which was a continuation of application Ser. No. 07/781,676 filed Oct. 24, 1991, now abandoned, which was a continuation of application Ser. No. 07/662,501 filed Feb. 28, 1991, now abandoned, which was a continuation of application Ser. No. 07/368,588 filed Jun. 20, 1989, now abandoned.

BACKGROUND OF THE INVENTION

1. Field of the Invention

This invention relates to an orifice plate in which through-holes defining orifices or discharge ports for discharging the ink of a recording head mounted on an ink jet recording apparatus used in a copying machine, a facsimile apparatus, a word processor, a printer for the output of a computer, a printer for video output or the like and positioning apertures for effecting the positioning of the recording head in the recording apparatus are provided with good arrangement accuracy, and to an ink jet recording head using said orifice plate as well as to an ink jet recording apparatus carrying said head thereon.

2. Related Background Art

An ink jet recording apparatus adopts a method of discharging ink as recording liquid, forming flying liquid droplets and causing the ink to adhere to a recording medium such as paper to thereby accomplish recording. Systems for forming ink droplets in such ink jet recording apparatus include a system generally called the continuous type wherein pressurized ink is made into a liquid droplet stream by imparting vibrations thereto by a piezo-electric element. Charges are imparted to the liquid droplet stream by an electrode and only the necessary droplets are deflected to thereby accomplish recording. Also known is a system called the on-demand type which utilizes, for example, a pressure change in a liquid path caused by the deformation of a piezo-electric element, and a system which uses a heat generating element as an ink discharge energy generating member as in the system described in U.S. Pat. No. 4,723,129 (Endo et al.) or U.S. Pat. No. 4,740,796 (Endo et al.) wherein a heat generating element is provided in a liquid path, and ink is suddenly heated and a liquid droplet is discharged by the force of the resultant bubble.

Among the above-described ink jet recording systems, particularly the system using a heat generating element as a discharge energy generating member, there are advantages such as the ease with which orifices for discharging ink-forming ink droplets is made highly dense with good accuracy, and the possibility of high-speed recording.

On the other hand, as the typical printing systems in the ink jet recording apparatus, there are the serial types in which use is made of a recording head having orifices arranged in a spacing narrower than the width of an image to be recorded and the recording head is scanned relative to a recording medium such as paper to thereby accomplish recording line by line. In addition the full line type has orifices which are arranged in the main scanning direction, for example, over the full width of an image to be recorded, and a recording head and a recording medium are moved relative to each other in the sub-scanning direction to thereby record one line substantially at a time.

Of the above-described two printing systems, full line type printers are being actively developed from the viewpoint that they can sufficiently meet the desire for high-speed recording. Moreover, in this full line type printing system, a number of recording heads having orifices arranged therein are juxtaposed to constitute a recording apparatus, whereby it becomes possible to accomplish recording in a larger area at a time. Further, attention has been paid to this printing system from the viewpoint that by the use of recording heads in which the arrangement density of orifices is enhanced, for example, the requirement for high-speed recording of colored images of high density and high quality can be met easily.

However, in a recording head in which there are arranged a plurality of heads each having several tens to several hundreds or several thousands of discharge ports, particularly, full line type heads, the influence of the arrangement accuracy of all the orifices upon the image recording accuracy is particularly critical therefore, it is necessary to make not only the arrangement accuracy of the orifices influenced by the arrangement of the recording heads, but also the arrangement accuracy of the orifices influenced by the relative positional relationship among the plurality of recording heads sufficient.

Description will hereinafter be made of the case of a recording apparatus of the conventional construction as shown, for example, in U.S. Pat. No. 4,477,823 (Matsufuji et al.) or U.S. Pat. No. 4,499,478 (Matsufuji et al.) wherein four recording heads 1 of the full line type in each of which fourteen ink jet elements 1*a* shown in FIG. 1A of the accompanying drawings having a number of orifices (not shown) arranged at a predetermined density are arranged in staggered relationship and juxtaposed as shown in FIG. 1B of the accompanying drawings. According to our experiment, it has been found that when the positions of the orifices in the direction of arrangement thereof and the degree of parallelism of the recording heads 1 are taken into consideration, the arrangement accuracy of at least ±¼ dot pitch (for example, ±30 μm if the arrangement density of the orifices is 8 dot/mm, or ±15 μm if said arrangement density is 16 dot/mm) is required in installing the recording heads 1.

However, the positioning of the recording heads in such an apparatus is accomplished by discretely attaching fixing jigs 2 and 3 to the body of each recording head 1 as shown in FIG. 1B, and providing positioning pins 4 and 5 at the locations of the recording apparatus whereat the recording heads 1 are installed.

More particularly, as shown in the enlarged perspective view of FIG. 1A, the degree of parallelism of all heads 1 and the arrangement accuracy (dimension A) of the orifices are determined by positioning holes 6 and 7 formed in the fixing jigs 2 and 3.

However, the fixing jigs 2, 3 and the positioning pins 4, 5 are made solely by machining, and for example, to obtain very precise arrangement accuracy of recording heads such as ±30 μm or ±15 μm as mentioned above, a high machining accuracy is required for making of these jigs and pins, and this has caused the cost of the recording heads to rise remarkably.

That is, in a recording apparatus having a plurality of recording heads of the conventional full line type, even if the recording head body has been made at no small cost by the use of a technique such as photolithography which enables fine working at high accuracy, it is the positioning method which is low in mass productivity and costly in working and assembling mechanical parts highly accurately that is inefficient and costly.

As a result of numerous experiments we have carried out repetitively, we have found that the above-noted problem of positioning also affects the quality of recorded images such as the ink discharge characteristic or the adherence of ink droplets to desired accurate locations on a recording medium. Further, as a result of experiments we have carried out, we have also found that the quality of images in not only the full line type heads but also the heads used in the serial system is affected by the above-described positioning of the discharge ports.

SUMMARY OF THE INVENTION

It is an object of the present invention to solve the above-noted problems and to provide a plate member which enables a great reduction in the manufacturing cost of a recording head, and a recording head using said plate member, as well as an ink jet recording apparatus carrying said head thereon.

It is another object of the present invention to provide an orifice plate which can easily enhance the arrangement accuracy of a plurality of orifices in an ink jet recording apparatus, and a recording head using said orifice plate, as well as an ink jet recording apparatus carrying said head thereon.

It is still another object of the present invention to provide an orifice plate provided with through-holes capable of defining orifices for discharging ink in a recording head mounted on an ink jet recording apparatus, characterized by the provision of positioning portions usable for the positioning of the orifices comprising said through-holes in said ink jet recording apparatus, to provide an ink jet recording head having an orifice plate formed with through-holes defining orifices for discharging ink, characterized in that apertures as positioning means for said orifices in a recording apparatus are provided in said orifice plate, and to provide an ink jet recording apparatus in which positioning is accomplished relative to the recording apparatus by the positioning means provided in the orifice plate.

It is yet still another object of the present invention to provide an orifice plate in which positioning apertures for use when a recording head using the orifice plate is mounted on a recording apparatus are provided with good accuracy and the desired arrangement accuracy of orifices provided in the recording head can be easily obtained by the use of said positioning apertures, and a recording head using said orifice plate, as well as an ink jet recording apparatus carrying said head thereon.

It is a further object of the present invention to provide an orifice plate in which said positioning apertures are formed correspondingly to the arrangement of orifices during the formation of the orifice plate, i.e., when through-holes providing the orifices are provided in a plate-like member.

It is still a further object of the present invention to provide an orifice plate in which when orifices are to be formed by the use of a method using photolithography, a pattern corresponding to positioning apertures and a pattern corresponding to orifices are formed in an exposure mask at a time with predetermined accuracy as will be described later, whereby the orifice plate is manufactured by effecting the ordinary exposure, development and etching process.

It is yet still a further object of the present invention to provide a recording head whose positioning apertures are automatically disposed in an orifice plate with good accuracy and therefore which eliminates the non-mass-productive process of discretely making positioning jigs by machining and attaching them to the recording head body with good accuracy, and an ink jet recording apparatus carrying said head thereon.

It is a further object of the present invention to provide an ink jet recording head which is constructed by the use of an orifice plate formed with positioning apertures, whereby eliminating the necessity of using jigs which require high machining accuracy and using a skillful apparatus assembling technique, and which is high in mass productivity and low in cost and enables good arrangement accuracy of orifices to be achieved, and to provide an ink jet recording apparatus in which the positioning of said head can always be easily achieved with good accuracy, In accordance with one aspect of the present invention, an ink jet recording head, for use with an ink jet recording apparatus having a mounting portion on which the ink jet recording head is mountable, comprises a head body member having a plurality of elements for generating thermal energy to discharge liquid that records on the recording medium, and an opening member having a plurality of discharge ports for discharging liquid therethrough in response to the generation of thermal energy by the elements, wherein the opening member includes a junction portion attached to the head body member, extension portions protruding from two ends of the junction portion and positioning members on the extension portions, the positioning members being precisely located relative to the discharge ports and being adapted to cooperate with positioning means on the apparatus for accurately positioning the discharge ports in the apparatus.

In accordance another aspect of the present invention, an ink jet recording apparatus comprises a recording head for recording on a recording medium, the recording head including a head body member having a plurality of elements for generating thermal energy to discharge liquid that records on the recording medium and an opening member having a plurality of discharge ports for discharging liquid therethrough in response to the generation of thermal energy by the elements, wherein the opening member includes a junction portion attached to the head body member, extension portions protruding from two ends of the junction portion and positioning openings in the extension portions, the positioning openings being precisely located relative to said discharge ports. The apparatus also comprises a head-mounting opening in the apparatus for accepting the head body member and positioning means cooperating with the positioning openings to accurately position the discharge ports in the apparatus when the head body member is inserted in the head-mounting opening.

DESCRIPTION OF THE PREFERRED EMBODIMENTS

A preferred embodiment of the present invention may be a plate member formed with a plurality of discharge ports and having a construction in which positioning portions for effecting the positioning relative to an apparatus are provided, and although the shape of the positioning portions is not specifically limited, a circular or polygonal closed through-hole or cut-in portion is preferable. Above all, it is preferable that positioning portions be provided at the opposite ends of the plate member and one of them be made into a circular aperture and the other positioning portion be made into a tapered cut-in portion or an elliptical aperture and fine adjustment can be accomplished by said other positioning portion with said circular aperture as a reference position. The material of the plate member is suitably selected from among those will not cause deformation or degeneration of the discharge ports and the positioning portions by ink used or the like. The material may be, for example, a metal material such as nickel or stainless steel, or a metal material surface-treated so that it may not be deteriorated by ink, or a hard resin material. It will be more preferable if the outer surface of the plate member in which the discharge ports are formed is subjected to ink-repelling surface treatment.

Also, the shape and number of the discharge ports may be a circle, an ellipse or a polygon corresponding at one to one to a discharge energy generating element generating discharge energy, or one discharge port may correspond to a plurality of discharge energy generating elements and the shape thereof may be a circle, an ellipse, a polygon or a slit-like shape.

In short, the plate member may be of a construction which can achieve the objects of the present invention, and is not restricted to embodiments hereinafter described.

[First Embodiment]

A first embodiment of the present invention will hereinafter be described in detail with reference to the drawings.

Figure 1A:
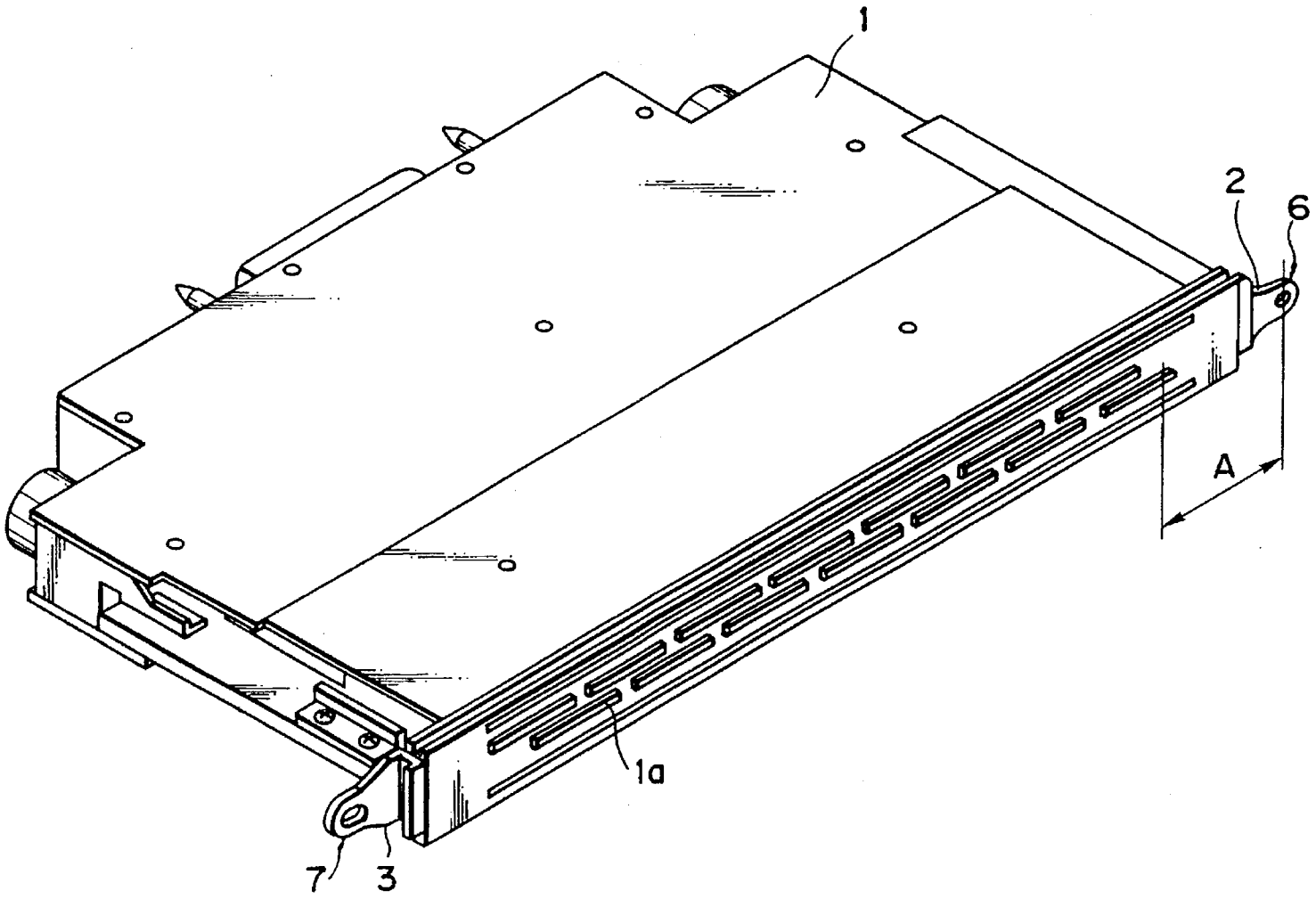
FIG. 1A PRIOR ART
FIG. 1A is a schematic perspective view showing the conventional construction of a full line type recording head.
Figure 1B:
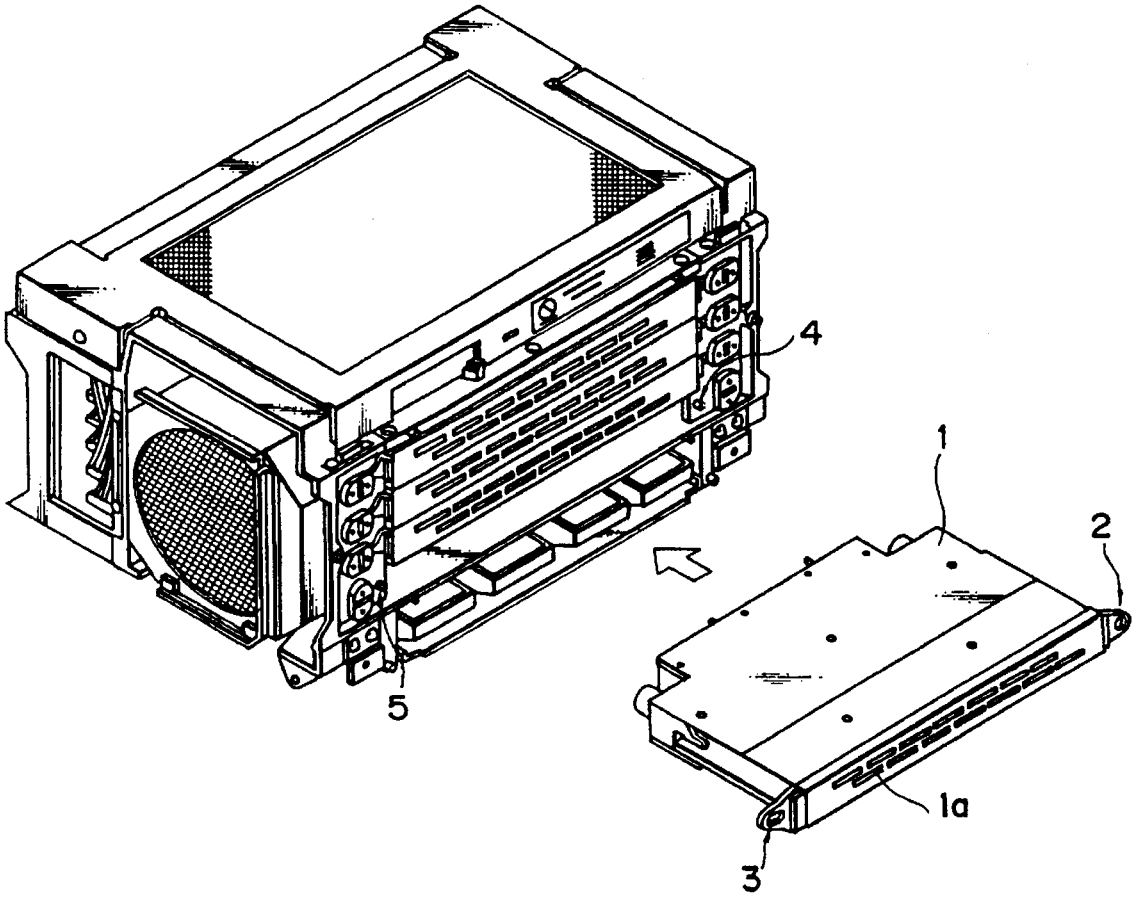
FIG. 1B PRIOR ART
FIG. 1B is a schematic perspective view showing the construction of the vicinity of the heads of an ink jet recording apparatus having a plurality of full line type recording heads.
Figure 2:
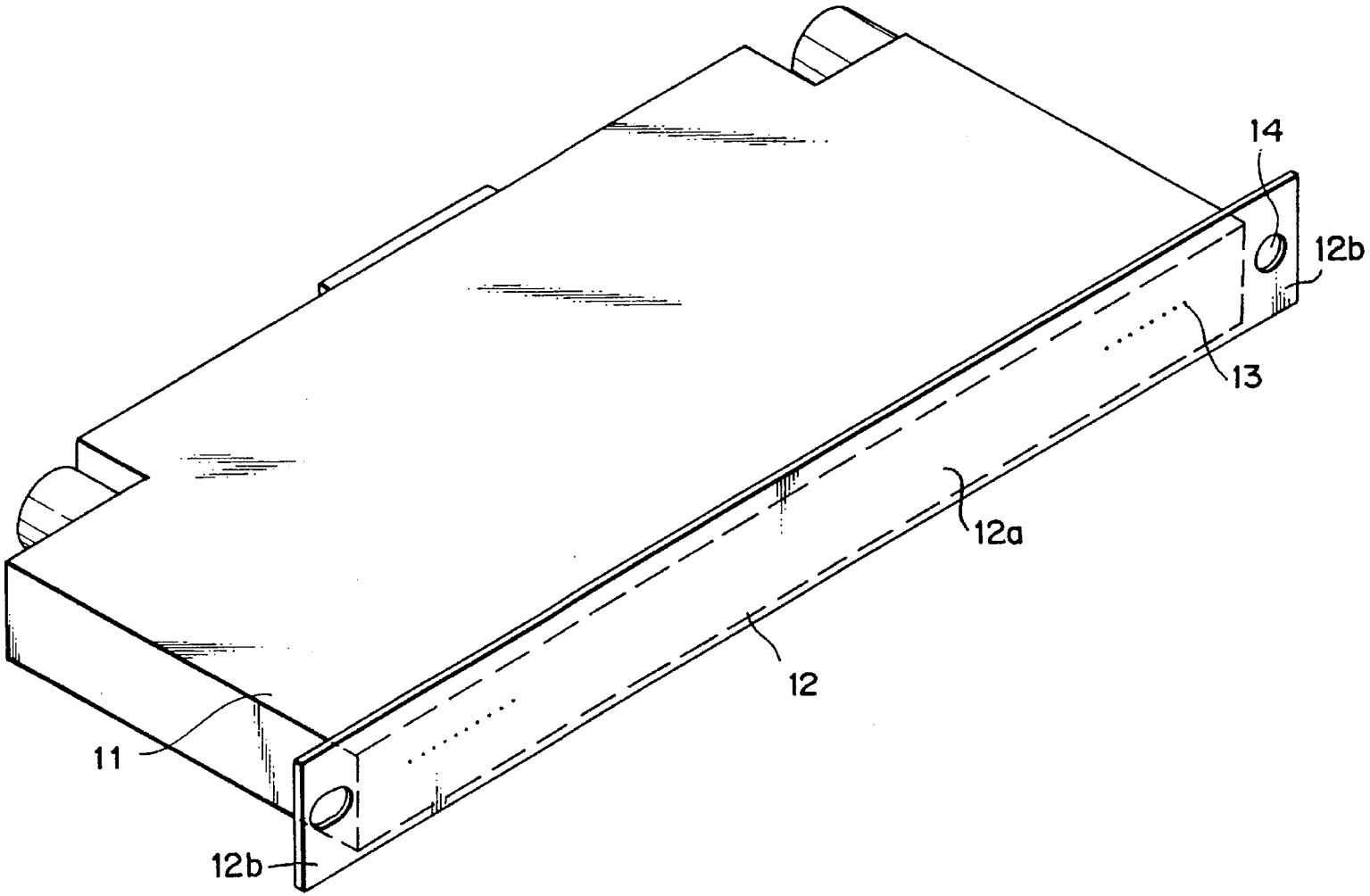
FIG. 2 is a schematic perspective view showing a recording head according to a first embodiment of the present invention.

FIG. 2 is a perspective view of an example of a full line type ink jet recording head using the orifice plate or opening of the present invention.

In this recording head 11, the orifice plate 12 is joined to the front face of the head body member, and the opposite end portions of the orifice plate 12 having a number of orifices 13 (the central ones thereof being not shown) arranged therein in a row are projected from the side surfaces of the body of the recording head 11, that is, from the junction portion 12*a* where the orifice plate 12 connects to the head 11. Positioning apertures 14 as positioning means are formed in these opposite end extension portions 12*b*.

These positioning apertures 14 have already been formed accurately correspondingly to the arrangement of the orifices 13 during the formation of the orifice plate 12 and therefore, if the positioning of the recording head in the recording apparatus is done by the use of these positioning apertures 14, high arrangement accuracy of the orifices 13 in the apparatus will be automatically obtained.

Moreover, if, for example, these positioning apertures 14 are formed at a time during the formation of the orifice plate 12 by photolithography as described hereinafter, highly accurate positioning apertures 14 can be formed very easily without the addition of any special process.

[Description of the Manufacturing Process of Orifice Plate]

Figure 3A:
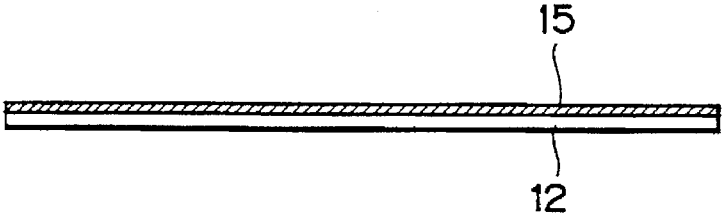
FIGS. 3A–3D are schematic views for illustrating the process of manufacturing an orifice plate according to the present invention.
Figure 3B:
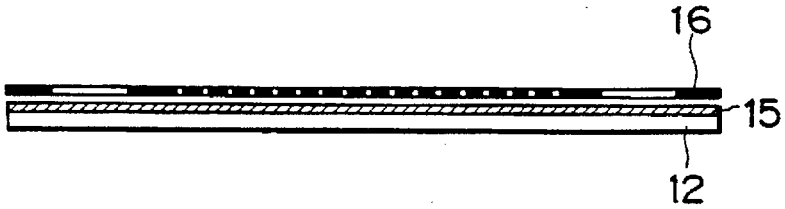
Figure 3C:
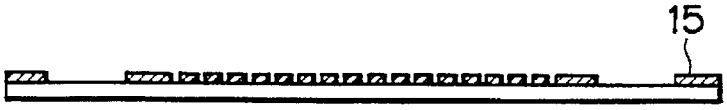
Figure 3D:
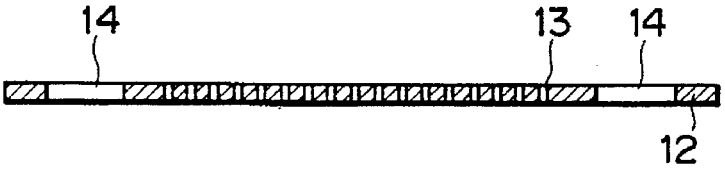

When the orifice plate 12 was to be formed by the use of the process as shown, for example, in FIGS. 3A–3D, a photoresist layer 15 was provided on the surface of the plate member 12 (FIG. 3A). This was exposure-processed through a mask 16 for exposure as shown in FIG. 3B. On this mask 16, a patterns corresponding to the positioning apertures 14 is provided with good accuracy in a predetermined positional relation with a pattern corresponding to the orifices 13. Thereafter, the ordinary developing and etching steps as shown in FIGS. 3C and 3D were carried out, whereby there could be obtained the orifice plate of the present invention in which the orifices 13 and the positioning apertures 14 were formed at the same time.

Figure 4:
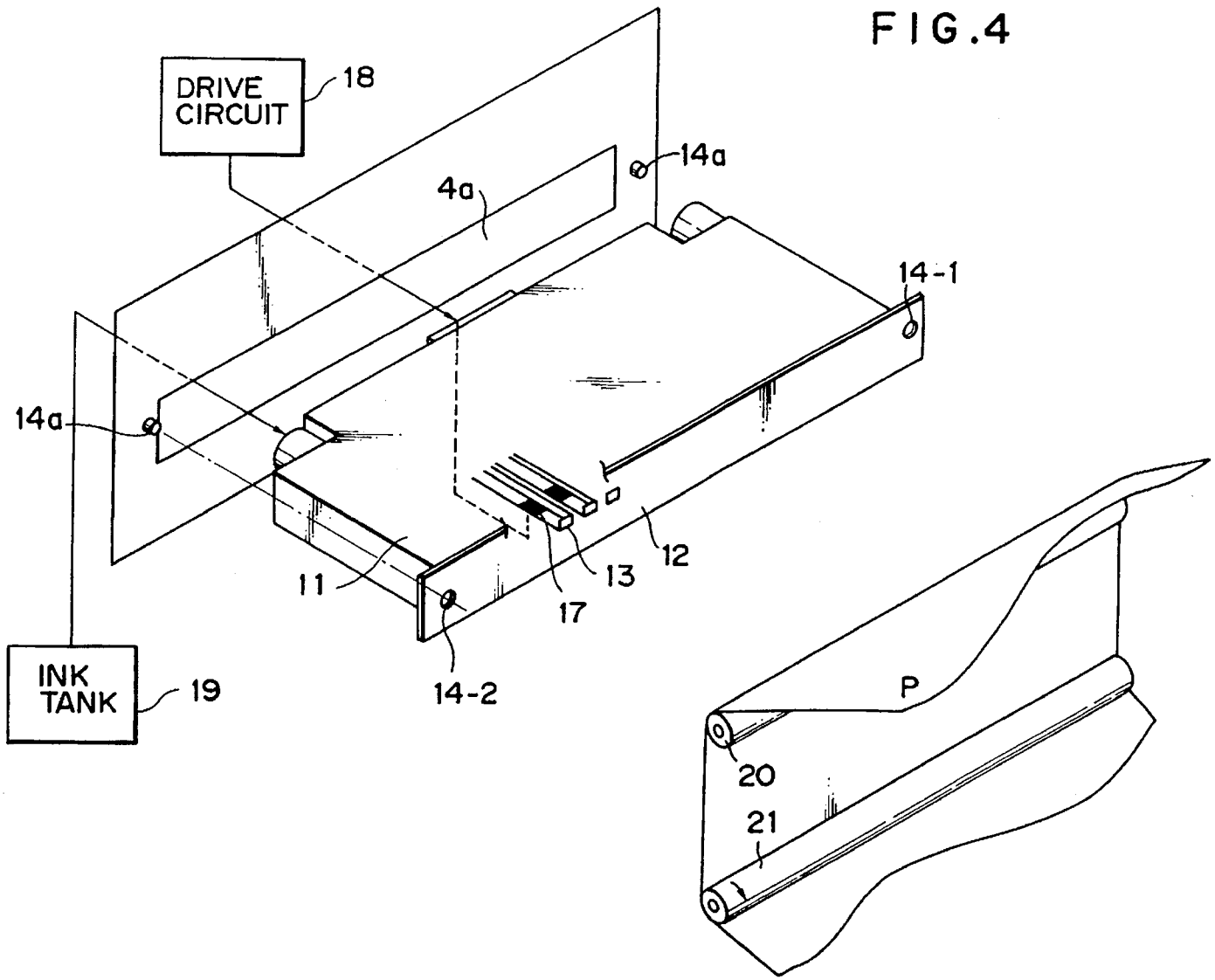
FIG. 4 is a schematic perspective view for illustrating the construction of an ink jet recording apparatus according to the present invention.

The orifice plate thus formed has arranged thereon electro-thermal converting members 17 as ink discharge energy generating members as shown, for example, in FIG. 4, and a recording signal is supplied from a drive circuit 18 to the electro-thermal converting members 17, which thus generate heat energy available for the discharge of ink.

At this time, a liquid path provided in the recording head 11 is filled with the ink supplied from an ink tank 19., and the imparted heat energy acts on the ink and due to the growth and contraction of a bubble created by the film boiling phenomenon, the ink is discharged from the discharge ports 13 to thereby form flying droplets. These droplets adhere to the surface of a recording medium P conveyed to a position opposed to the discharge ports 13 by conveying rollers 20 and 21 and thus, image recording by a dot pattern is accomplished.

According to this construction, the positioning of the discharge ports is accomplished by the positioning reference being taken by a positioning aperture 14-1 with the aid of the positioning portion of the orifice plate and holding means for holding the same, and being determined by a finely adjustable elliptical second positioning aperture 14-2. That is, the positioning apertures 14-1 and 14-2 accept the positioning pins 14*a* as the recording head 11 enters the head-mounting opening 4*a* in the apparatus, thereby accurately positioning the discharge ports in the apparatus. Accordingly, the positions of the discharge ports 13 from which the ink is finally discharged do not fluctuate and therefore, good recording is accomplished.

[Second Embodiment]

Figure 5:
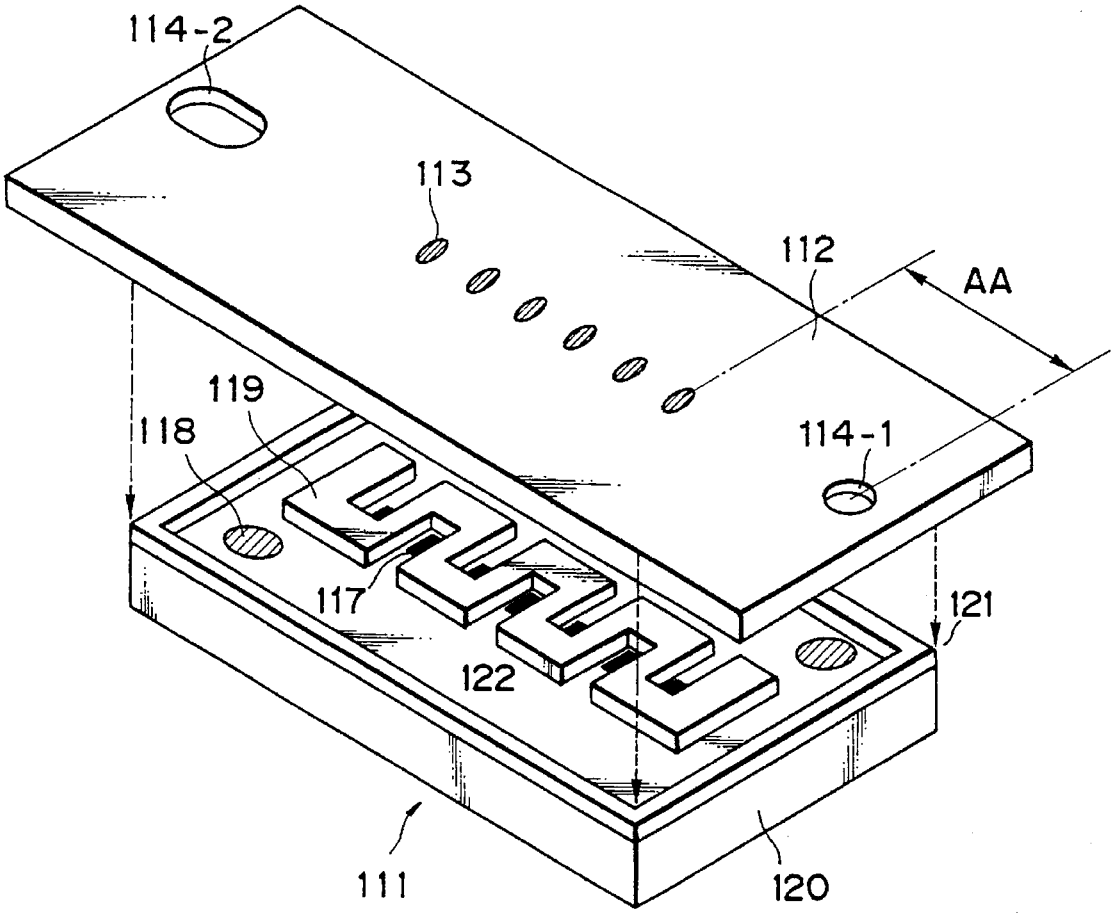
FIG. 5 is a schematic perspective view for illustrating the construction of a recording head according to a second embodiment of the present invention.

FIG. 5 is a schematic perspective view showing a recording head according to a second embodiment of the present invention.

This recording head 111 is a head of the type which discharges ink in a direction intersecting a heat generating surface on which electro-thermal converting members 117 are provided. This head 111 is of a construction in which an orifice plate or opening member 112 provided with positioning apertures 114-1 and 1141-2 is joined at a junction to a support member or head body member 120 formed, for example, of Si and provided with an ink supply hole 118 for supplying ink to an ink chamber 122 from an ink tank, not shown, similar to the ink tank 19 shown in FIG. 4, through a barrier 119 formed of a hardened film of photosensitive resin or the like as a liquid path forming member and surrounding each electro-thermal converting member 117 from the three sides thereof, and a wall 121 formed of a hardened film of photosensitive resin and forming an ink chamber 122.

A method of manufacturing the orifice plate shown in FIG. 5 will now be described.

A plate-like member formed of Ni for forming the orifice plate was first prepared. Also, a rigid large punching mold formed with protrusions corresponding to the size, shape and arrangement pitch of discharge ports to be formed and to positioning apertures was prepared.

The plate-like member was then fixed to the support member of a punching machine, the mold was urged thereagainst and through-holes corresponding to the protrusions were formed in the plate-like member by a shearing force.

Thorn-like protrusions created near the through holes were polished to thereby obtain good planarity and complete the orifice plate.

In a recording head having the orifice plate thus obtained, the positioning apertures of the recording head are already provided in the orifice plate and therefore, there is no necessity of adding positioning jigs as in the prior-art recording head and moreover, even when the operation as described. above is repeated to manufacture a number of recording heads, the dimension AA shown, for example, in FIG. 5, can always be obtained uniformly and very easily and thus, the arrangement accuracy of the recording heads is greatly improved.

[Third Embodiment]

Figure 6:
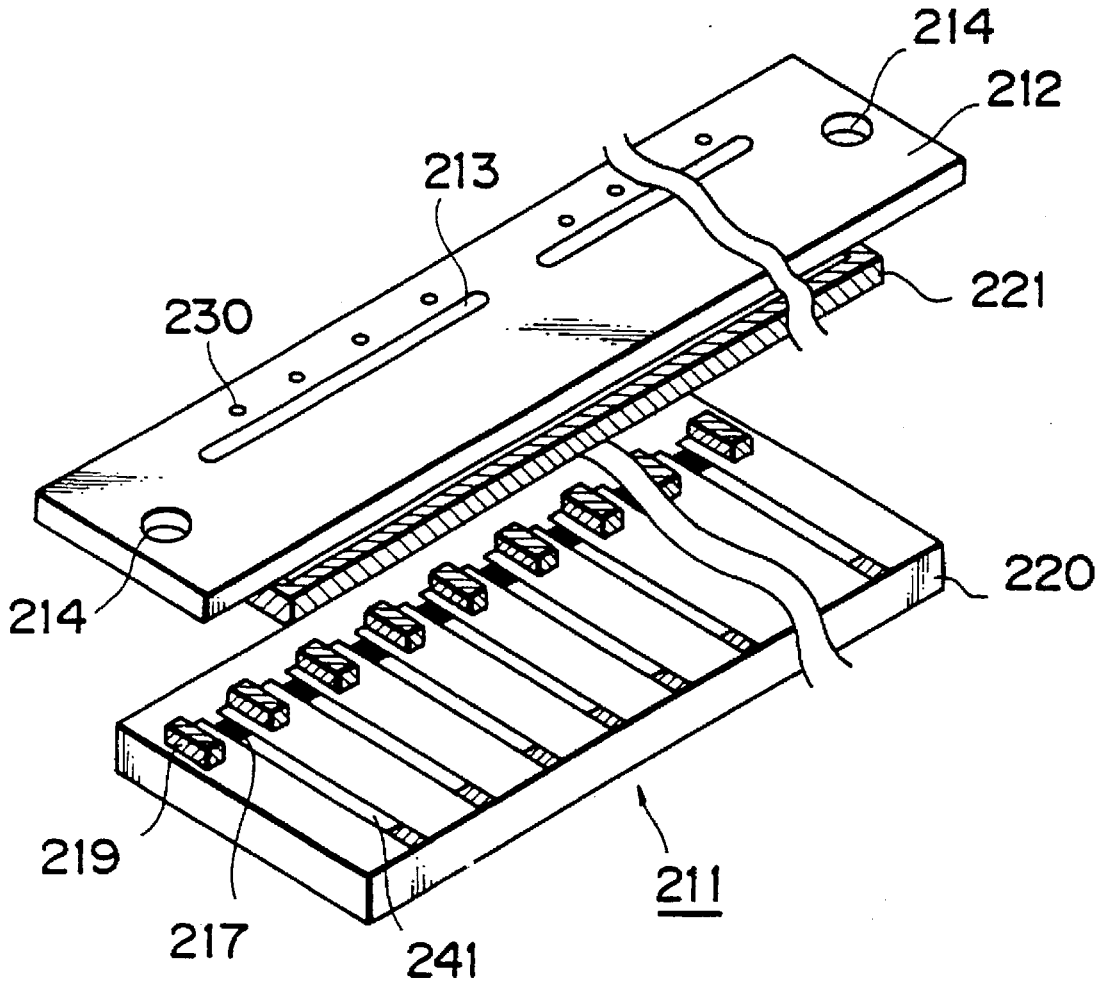
FIG. 6 is a schematic perspective view for illustrating the construction of a recording head according to a third embodiment of the present invention.

FIG. 6 is a schematic perspective view showing a recording head according to a third embodiment of the present invention.

In such a construction, four electro-thermal converting members share one discharge slit and therefore the working of the slit is easy, but a portion in the slit which discharges an ink droplet is defined substantially by the slit and a fluid resistance element which will be described later and therefore, the positioning as by the present invention becomes necessary for obtaining good images.

The present embodiment is substantially similar in construction to the above-described second embodiment, and differs from the latter in that as described above, one slit corresponds to a plurality of electro-thermal converting members and droplets forming a plurality of dots are discharged from one slit.

The reference numeral 220 designates a glass substrate, on which is provided a heat generating resistance layer, on which are disposed patterned A1 electrodes 241, whereby electro-thermal converting members 217 are constituted. A protective layer formed of $SiO_2$ is provided on the electro-thermal converting members 217 and electrodes 241 to thereby constitute a heater board.

Fluid resistance elements 219 are disposed on the opposite sides of each electro-thermal converting member 217, whereby pressure waves can be prevented from being propagated in the lengthwise direction of the slit, i.e., the direction of arrangement of the electro-thermal converting members.

As regards pressure waves in the horizontal direction, the interference therebetween is prevented by the use of openings 230.

That is, as regards also the openings 230 provided in each electro-thermal converting member 217 to prevent the interference between the pressure waves and to exhaust created minute bubbles, they are rightly positioned by the construction of the present invention to thereby display the effect thereof at its maximum.

The reference numeral 221 denotes a spacer which keeps the spacing between the slit plate 212 and the substrate 220 constant and defines a liquid path.

The recording head 211 is fixed to the head supporting means (not shown) of the apparatus with the aid of positioning apertures 214, whereby positioning of the head is accomplished.

As described above, according to the present invention, during the formation of the orifice plate, the positioning apertures of the recording head are formed with good accuracy simultaneously with the through-holes which provide the orifices and therefore, accurate positioning of the recording head using the orifice plate is simplified.

Also, since the positioning apertures in the orifice plate can be easily formed without the addition of any special high-degree process, an ink jet recording head having highly accurate and inexpensive positioning apertures can be obtained with ease.

What is claimed is:

1. A method for manufacturing a resin orifice plate, the orifice plate having a plurality of discharge ports and a positioning opening, for use in an ink jet head having a plurality of energy generating elements for generating discharge energy for discharging an ink, the discharge ports being provided in correspondence with the energy generating elements, comprising the steps of:

providing a resin plate member;

applying a layer of a photoresist material onto the plate member;

exposing the plate member, through a mask, to light radiation so as to form a pattern corresponding to the discharge ports and the positioning opening on the layer of the photoresist material; and developing the photoresist layer;

etching the plate member; and removing the photoresist layer, thereby forming in the plate member both the discharge ports and the positioning opening.

2. A method according to claim 1, wherein at least one said discharge port is slit-shaped.

3. A method according to claim 1, wherein at least one said energy generating element is an electrothermal converting element.

4. A method for manufacturing a resin orifice plate, having a plurality of discharge ports and a positioning opening, for use in an ink jet apparatus having a plurality of ink jet recording heads each having a plurality of energy generating elements for generating discharge energy for discharging an ink, the discharge ports being provided in correspondence with the energy generating elements, and a positioning section corresponding to said positioning opening, comprising the steps of:

providing a resin plate member;

applying a layer of a photoresist material onto the plate member;

exposing the plate member, through a mask, to light radiation so as to form a pattern corresponding to the discharge ports and the positioning opening on the layer of the photoresist material; and developing the photoresist layer;

etching the plate member; and removing the photoresist layer, thereby forming in the plate member both the discharge ports and the positioning opening.

5. A method according to claim 1, wherein at least one said discharge port is slit-shaped.

6. A method according to claim 1, wherein at least one said energy generating element is an electrothermal converting member.

* * * * *

UNITED STATES PATENT AND TRADEMARK OFFICE

CERTIFICATE OF CORRECTION

PATENT NO. : 5,659,343

DATED : August 19, 1997

INVENTOR(S): YUTAKA KOIZUMI ET AL.

It is certified that error appears in the above-identified patent and that said Letters Patent is hereby corrected as shown below:

ON TITLE PAGE AT ITEM [57] IN THE ABSTRACT

Delete Abstract and substitute the following therefor:

--A method for manufacturing a resin orifice plate, the orifice plate having plural discharge ports and a positioning opening, for use in an ink jet head having plural energy generating elements for generating discharge energy for discharging ink, the discharge ports being provided in correspondence with the energy generating elements, involves the steps of providing a resin plate member, applying a layer of photoresist material onto the plate member, exposing the plate member, through a mask, to light radiation so as to form a pattern corresponding to the discharge ports and the positioning opening on the layer of the photoresist material, and developing the photoresist layer. The method also involves etching the plate member and removing the photoresist layer, thereby forming in the plate member both the discharge ports and positioning opening.--.

COLUMN 1

Line 6, "continuation-in-part" should be deleted.

COLUMN 2

Line 18, "critical" should read --critical and--.

COLUMN 4

Line 28, "accordance" should read --accordance with--.

UNITED STATES PATENT AND TRADEMARK OFFICE

CERTIFICATE OF CORRECTION

PATENT NO. : 5,659,343

DATED : August 19, 1997

INVENTOR(S): YUTAKA KOIZUMI ET AL.

It is certified that error appears in the above-identified patent and that said Letters Patent is hereby corrected as shown below:

COLUMN 5

Line 19, "those" should read --those that--;
Line 44, "plate" should read --plate or open member--;
Line 54, "correspondingly" should read --corresponding--;
Line 65, "Orifice" should read --the Orifice--.

COLUMN 6

Line 4, "patterns" should read --pattern--;
Line 19, "19.," should read --19,--;
Line 50, "1141-2" should read --114-2--.

COLUMN 7

Line 13, "described." should read --described--.

UNITED STATES PATENT AND TRADEMARK OFFICE

CERTIFICATE OF CORRECTION

PATENT NO. : 5,659,343

DATED : August 19, 1997

INVENTOR(S): YUTAKA KOIZUMI ET AL.

It is certified that error appears in the above-identified patent and that said Letters Patent is hereby corrected as shown below:

COLUMN 8

Line 58, "claim 1," should read --claim 4,--;

Line 60, "claim 1," should read --claim 4,--.

Signed and Sealed this

Fifth Day of May, 1998

Bruce Lehman

BRUCE LEHMAN

*Commissioner of Patents and Trademarks*

*Attest:*

*Attesting Officer*